United States Patent [19]

Mori

[11] Patent Number: 4,685,232

[45] Date of Patent: Aug. 11, 1987

[54] INDEX DEVICE

[75] Inventor: Chuzo Mori, Funabashi, Japan

[73] Assignee: Carl Manufacturing Co., Ltd., Tokyo, Japan

[21] Appl. No.: 774,501

[22] Filed: Sep. 10, 1985

[51] Int. Cl.[4] ..... B42F 17/34

[52] U.S. Cl. ..... 40/381; 40/378; 40/532

[58] Field of Search ..... 40/381, 378, 508, 509, 40/532

[56] References Cited

U.S. PATENT DOCUMENTS 4,064,643 12/1977 Greif ..... 40/381

4,070,776 1/1978 Mitsuhashi ..... 40/381

4,236,334 12/1980 Kimura ..... 40/378

*Primary Examiner*—Gene Mancene

*Assistant Examiner*—Wenceslao J. Contreras

*Attorney, Agent, or Firm*—Armstrong, Nikaido, Marmelstein & Kubovcik

[57] ABSTRACT

An indexing device having a container for holding a plurality of cards therein and a cover pivotally mounted to the container by means of a shaft. When the cover is opened by the force of a resilient spring, the card placed at a desired location is exposed. A damping mechanism is provided around the shaft of the device to prevent the cover from being suddenly swung open, which would otherwise be caused by the resilient force.

7 Claims, 7 Drawing Figures

INDEX DEVICE

BACKGROUND OF THE INVENTION

The present invention relates to an indexing device that holds a number of cards bearing telephone numbers or other indexes in a container having an openable cover and, more particularly, to an indexing device in which the opening speed of the openable cover is controlled.

An indexing device for holding cards bearing telephone numbers or other indexes consists of an open-topped container and a cover with an open bottom. A shaft passes through wall portions of both the container and the cover so that the cover is pivotally mounted to the container to make the cover openable. When a locking member holding the cover closed is released, the resilient force of a resilient member is used to open the cover. A large number of cards are stacked between the container and the cover. A selection device is provided for separating the cards at a desired point so that when the cover is opened the required card is exposed at the top of the stack.

In such a prior art indexing device constructed as described above, the velocity at which the cover opens depends on the resilient force of the resilient member. Therefore, the resilient member quickly opens the cover. The resultant reaction may raise the indexing device itself, if it is light in weight. Then, the device will collide with the base on which the device was placed, production a large unpleasant sound.

In an attempt to solve the foregoing problems, some indexing devices have been so designed that their containers are heavy to minimize the motion of the device when the cover opens quickly. However, limitations imposed on the usage of the indexing device make it impossible to increase the weight greatly.

The prior art indexing device encounters another problem. More specifically, the cover is equipped with card-elevating elements to elevate some cards when the cover is opened. Then, the elevated cards are held within the opened cover so that the user can have access to a desired card. However, when the cover is opened quickly as mentioned above, the cards underlying the desired card may be elevated by the card-elevating elements together with the cards above the desired one.

SUMMARY OF THE INVENTION

It is the object of the present invention to provide an indexing device free of the foregoing problems. More specifically, it is the object of the invention to provide an indexing device whose cover is not snapped open but opens slowly immediately after one side of the cover is released from the container of the indexing device.

The above object is achieved in accordance with the teachings of the invention by an indexing device comprising a container having an open face, a cover pivotally mounted on a shaft passing through side walls of both the container and the cover, the container cooperating with the cover to hold a plurality of cards stacked therebetween, a resilient member producing a resilient force tending to open the cover when it is unlocked and to expose a desired one of the cards, and damping means including a viscous medium around said shaft for providing viscous resistant to the resilient force produced by the resilient member.

DETAILED DESCRIPTION OF THE INVENTION

Figure 1:
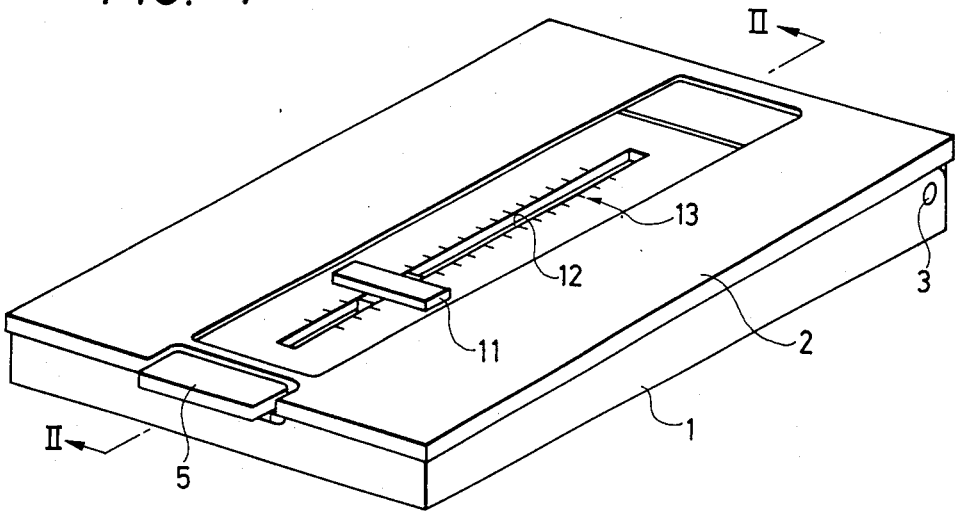
FIG. 1 is a perspective view of the indexing device.

The present invention will be described in connection with a preferred embodiment thereof with reference to the accompanying drawings, it being understood that the present invention is not limited to this preferred one.

The illustrated indexing device has an elongate container 1 for holding cards. The container 1 is open at its upper face. The open face of the container 1 is covered by a cover 2 which is pivotally mounted along one edge to a corresponding edge of the container 1 by a shaft 3. Therefore, the cover 2 can swing open from the container 1. A hooked retaining portion 4 formed in the center of the front end portion of the cover 2 is held to a catching element 5 which is disposed at the front end portion of the container 1 and provided with a retaining hole 5*a*. Thus, the cover remains closed. The lower end of the catching element 5 is fixed to the container 1. When the catching element 5 is depressed, it swings down about its lower end. Then, the retaining portion 4 of the cover 2 comes out of the hole 5*a*, whereupon the resilient force of a resilient member 6 causes the cover 2 to swing open about the shaft 3. The resilient member 6 is fixedly mounted on the shaft 3. One end of the resilient member 6 is pressed against the inner surface of the cover 2, while the other end is pressed against the inner bottom of the container 1.

Figure 3:
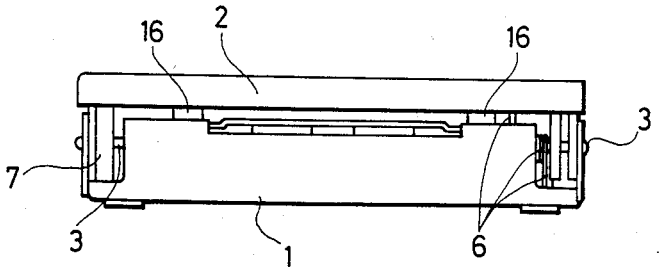
FIG. 3 is a rear view of the device shown in FIG. 1.
Figure 4:
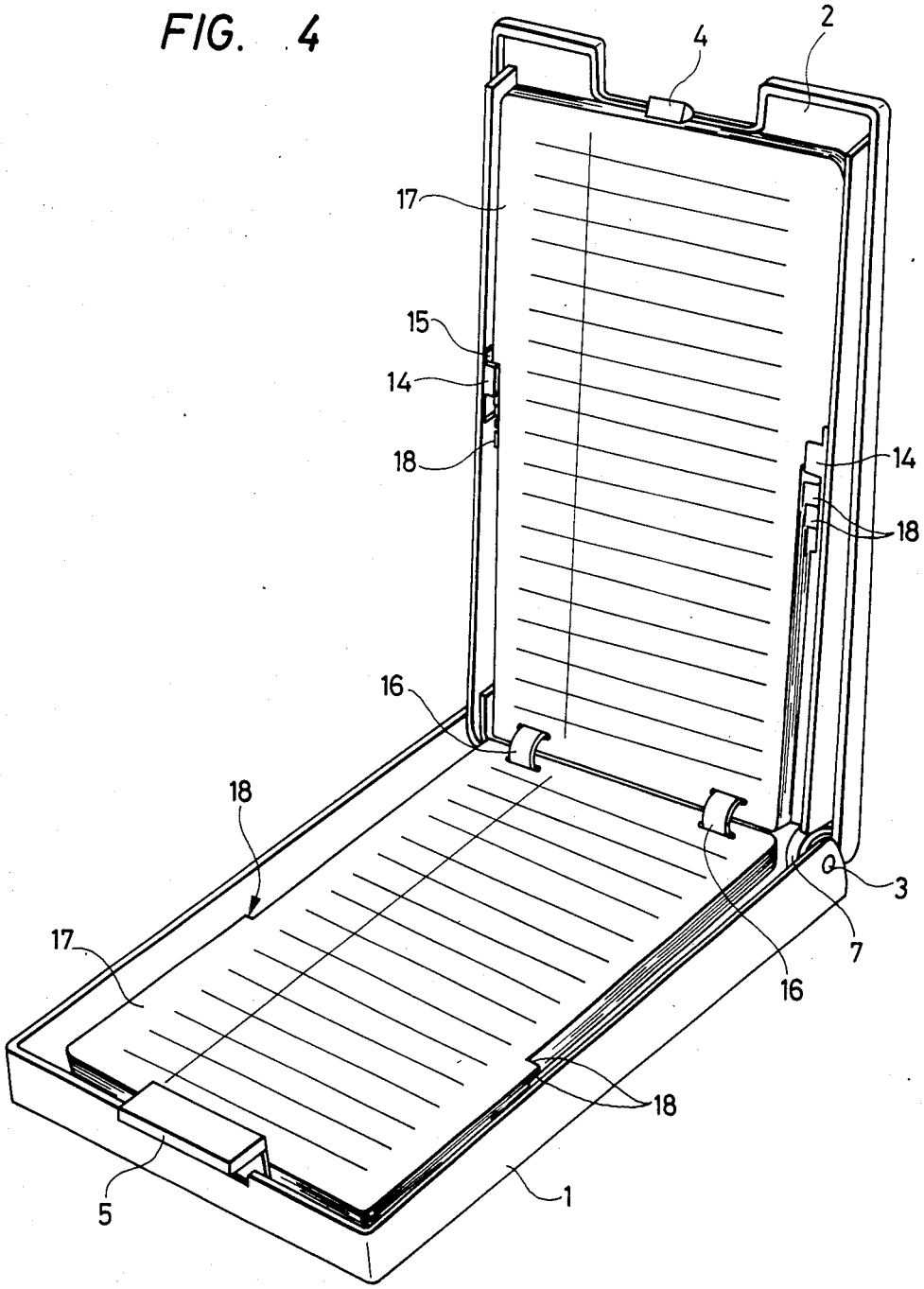
FIG. 4 is a perspective view of the device shown in FIG. 1, for showing the condition in which the cover is open.

Referring to FIGS. 3 and 4, a damper mechanism 7 is disposed on the shaft 3 at the opposite end to the resilient member 6. This mechanism 7 provides viscous resistance to the resilient force produced by the resilient member 6 to thereby reduce the velocity at which the cover 2 swings open from the container 1.

Figure 5:
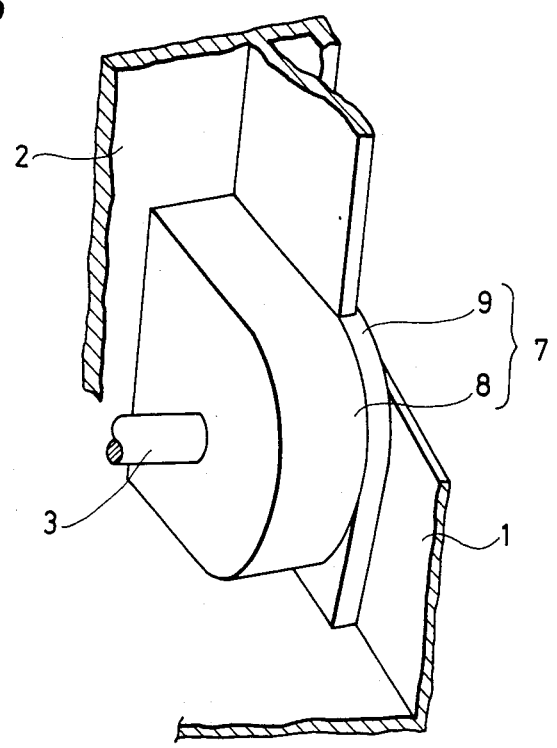
FIG. 5 is an enlarged perspective view of a damper mechanism incorporated in the device shown in FIG. 1.
Figure 6:
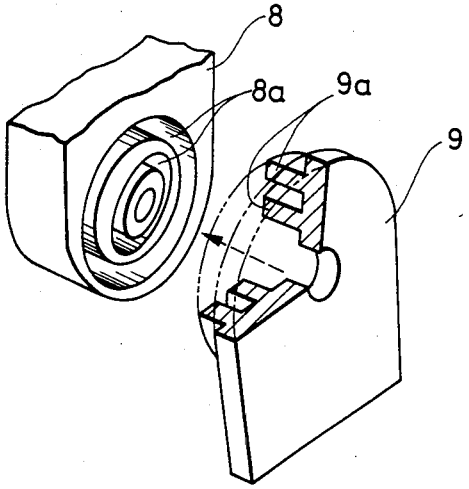
FIG. 6 is an exploded view partially in section of the damper mechanism shown in FIG. 6.
Figure 7:
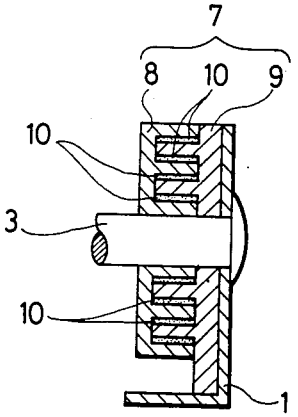
FIG. 7 is a vertical cross-sectional view of the damper mechanism shown in FIGS. 5 and 6.

The damper mechanism 7 is described in greater detail with reference to FIGS. 5 to 7. The mechanism 7 has a first rotor 8 provided with annular grooves 8*a*. The shaft 3 extends through the center of the first rotor 8, which is firmly fixed to the inner surface of the base portion of the cover 2. The mechanism 7 further has a second rotor 9 that rotates relative to the first rotor 8. The second rotor 9 has annular projections 9*a* which are loosely inserted in the annular grooves 8*a* in the first rotor 8. The shaft 3 also extends through the center of the second rotor 9. The first rotor 8 is fitted to the second rotor 9 in such a way that gaps are left between the grooves 8*a* and the projections 9*a*. These gaps are filled with a viscous medium 10 that exhibits viscous resistance. The second rotor 9 has a U-shaped contour, one flat side of which is in contact with the inner bottom of the container 1. Therefore, even when the first rotor 8 rotates, the second rotor 9 will not move in the same sense as the first rotor 8, that is it will not follow the movement of the first rotor 8.

The viscous medium 10 can be a viscous substance having a high molecular number, for example, rubber or other similar material, or a mixture of any one of these materials and other additive. The visous medium 10 should be non-volatile. Preferably, its viscosity does not change greatly with changes in temperature. The viscous medium 10 may be a high viscosity silicone grease, e.g., product Nos. G330, G331, etc., produced by Shinetsu Chemical Industries Co. Ltd.

In the illustrated example, the number of the annular grooves 8*a* in the first rotor 8 and the number of the annular projections 9*a* of the second rotor 9 fitted in the grooves 8*a* are made large so that the viscous medium 10 is in contact with a relatively large area of the rotors 8 and 9 over a wide radial extent, in order to increase the viscous resistance exhibited by the viscous medium 10.

A similar damping effect may also be obtained by directly inserting a viscous medium between the shaft of the indexing device and its bearing.

Referring back to FIGS. 1 and 2, a transparent moving element 11 moves while guided by a groove 12 formed longitudinally in the center of the cover 2. The moving element 11 can come to a halt at each position indicated by index marks 13 placed on the outer surface of the cover 2. A card elevator 15 made of a metal sheet is attached to the lower end of the moving element 11. The elevator 15 has claws 14 for elevating cards at both sides.

A pair of C-shaped card binding elements 16 is mounted to the shaft 3. One end of each index card 17 (see FIG. 4) is bound to the binding elements 16. As shown in FIG. 4, each of the stacked cards 17 has a cut-away portion and a laterally extending tab 18 at its lateral edges. The claws 14 of the card elevator 15 engage the tabs 18 to feed the cards. The length of the tab 18 on each card 17 is so set that it becomes larger successively from the top card toward the lowermost card. When the cover 2 is opened, some cards 17 are swung upward and retained there, depending on the position of the card elevator 15, which depends on the position of the moving element 11.

Figure 2:
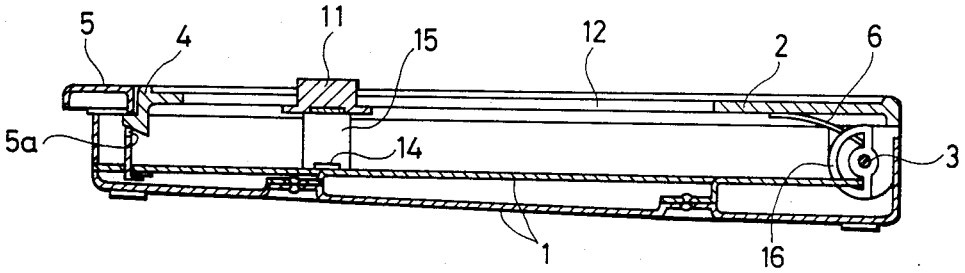
FIG. 2 is a cross-sectional view taken along line II—II of FIG. 1.

The operation of the indexing device constructed as described above will now be described. A given number of index cards 17 are bound to the card binding elements 16. When the holder is not used, the cover 2 is depressed against the resilient force exerted by the resilient member 6 to bring the retaining portion 4 of the cover 2 into engagement with the catching element 5 of the container 1, whereby the cover 2 is closed as shown in FIG. 1.

When the user requires access to a desired one of the index cards 17, the moving element 11 is placed at the position indicated by the desired index mark 13 written on the cover 2. Then, the catching element 5 is pulled toward the user and depressed. This disengages the catching element 4 of the cover 2 from the catching element 5. The resilient force of the resilient member 6 causes the cover 2 to swing open and, at the same time, the claws 14 of the card elevator 15 elevate some cards 17, depending on the desired index mark 13. Thus, the user can see the exposed, desired card.

Immediately after the cover 2 is opened, the resilient force of the resilient member 6 is large, and therefore the viscous resistance is also large. Accordingly, the cover 2 opens slowly. Consequently, it is unlikely that the opening operation of the cover will cause the device to move as encountered with prior art indexing devices. Further, when some cards are elevated by the card elevator, cards underlying the desired one will not be raised.

The velocity at which the cover 2 opens can be controlled, depending on the viscosity of the viscous medium 10, on the resilient force of the resilient member 6, and on the number of the cards 17 to be elevated, i.e., the total weight of these cards.

As described thus far, the novel indexing device is equipped with a damper mechanism that can slow down the movement of the cover immediately after the cover is released from the container. Hence, the cover will not be opened as quickly by the resilient force of the resilient member, as in the conventional indexing device. Consequently, the raising of the device itself by the sudden opening is prevented. This eliminates the collision of the container with the base on which it was placed, producing an impulsive sound. Also, the bearing will not become damaged, which would often be caused by the quick opening of the cover in the past. In addition, it is not necessary to make the device heavy to prevent it from being raised, unlike the prior art device. In this way, the novel device is much superior in usability and availability to the conventional device. Furthermore, since the cover opens slowly, a desired number of the cards can be correctly picked up from the multiplicity of stacked cards and raised. Wrong cards will not be raised, because the cover does not open suddenly, unlike the conventional device.

What is claimed is:

1. An indexing device comprising:

a container having an open face, a cover pivotally mounted on a shaft passing through side walls of both the container and the cover, the container cooperating with the cover to hold a plurality of cards stacked therebetween, a resilient member producing a resilient force tending to open the cover when it is unlocked and to expose a desired one of the cards, and damping means including a viscous medium around said shaft for providing viscous resistance to the resilient force produced by the resilient member.

2. An indexing device as claimed in claim 1, wherein the damping means comprises a member fixed to the shaft and a member fixed to the device, one of said members defining annular projections which are engaged in annular grooves provided on the other said member, the viscous medium being received between said annular grooves and projections.

3. An indexing device as claimed in claim 1, wherein the viscous medium is a non-volatile substance, the properties of which do not vary greatly with temperature changes.

4. An indexing device as claimed in claim 1, wherein the viscous medium comprises a viscous compound of high molecular member.

5. An indexing device as claimed in claim 1, wherein the viscous medium is directly inserted between the shaft and a bearing portion for said shaft.

6. An indexing device as claimed in claim 2, wherein the viscous medium is a non-volatile substance, the properties of which do not vary greatly with temperature changes.

7. An indexing device as claimed in claim 2, wherein the viscous medium comprises a viscous compound of high molecular number.

* * * * *